United States Patent [19]

Sontheimer

[11] 4,277,995

[45] Jul. 14, 1981

[54] ROTARY SLICING TOOL FOR MAKING NEAT, COMPLETE SLICES IN A FOOD PROCESSOR

[76] Inventor: Carl G. Sontheimer, 14 Gray Oakes La., Greenwich, Conn. 06830

[21] Appl. No.: 17,450

[22] Filed: Mar. 5, 1979

[51] Int. Cl.[3] ..... B26D 1/147

[52] U.S. Cl. ..... 83/150; 83/355; 83/592; 241/92

[58] Field of Search ..... 83/149, 150, 162, 164, 83/165, 355, 356.3, 591, 592, 663, 666; 241/92, 282.1

[56] References Cited

U.S. PATENT DOCUMENTS

| | | | |
|---|---|---|---|
| 419,364 | 1/1890 | Schoell | 83/356.3 |
| 1,398,257 | 11/1921 | Chrzastek | 83/591 X |
| 1,606,302 | 11/1926 | Kent | 83/591 X |
| 1,898,160 | 2/1933 | Aeschback | 83/591 X |
| 1,965,501 | 7/1934 | Knott | 83/592 X |
| 2,462,105 | 2/1949 | Kobey | 83/165 |
| 2,492,260 | 12/1949 | Bingham | 83/165 |
| 3,892,365 | 7/1975 | Verdun | 241/92 |
| 3,985,304 | 10/1976 | Sontheimer | 241/92 |
| 4,113,190 | 9/1978 | Fudman | 241/92 |
| 4,127,342 | 11/1978 | Coggiola | 403/243 |

FOREIGN PATENT DOCUMENTS

| | | | |
|---|---|---|---|
| 1305187 | 10/1962 | France | 241/282.1 |
| 1323667 | 3/1963 | France | 241/282.1 |

*Primary Examiner*—J. M. Meister

*Attorney, Agent, or Firm*—Parmelee, Johnson, Bollinger & Bramblett

[57] ABSTRACT

A rotary slicing tool is provided for a food processor having a hub with a horizontal disc-like member carrying an elevated slicing blade. The disc-like member has a horizontal area with an arcuate slot extending from the hub out to the periphery. The slicing blade is mounted on an elevated arcuate rim behind the slot with the cutting edge projecting forward and elevated above the horizontal area facing forward above the slot for slicing food items, with the slices passing down through the slot. For avoiding smashing or shredding of slices, a gradually sloping shoulder joins the horizontal area with the elevated platform having the rim where the slicing blade is mounted. Both ends of the blade are contoured to conform with the rotational direction of travel; the outer end conforming with the periphery of the disc-like member, and the inner end conforming with the hub, and the cutting edge is spaced well forward of the shoulder near both ends of the slicing blade. The shoulder is also gently sloped, rounded and contoured to conform with the motion of the disc relative to the slices being formed and passing through the slot in the fast-turning tool, whereby food items are uniformly sliced by the blade with the slices being gently deflected by or missing the gradually sloping contoured shoulder without being smashed or otherwise damaged particularly near the outer end of the fast-revolving slicing blade.

5 Claims, 8 Drawing Figures

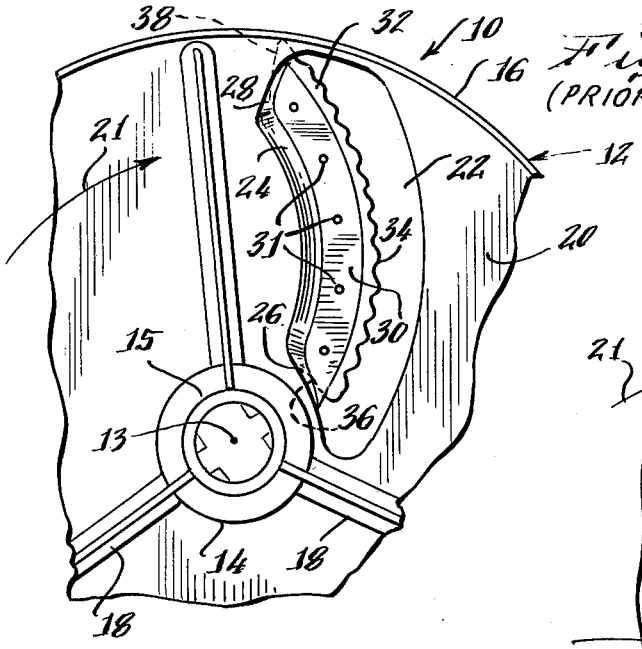
Fig. 5.
(PRIOR ART)
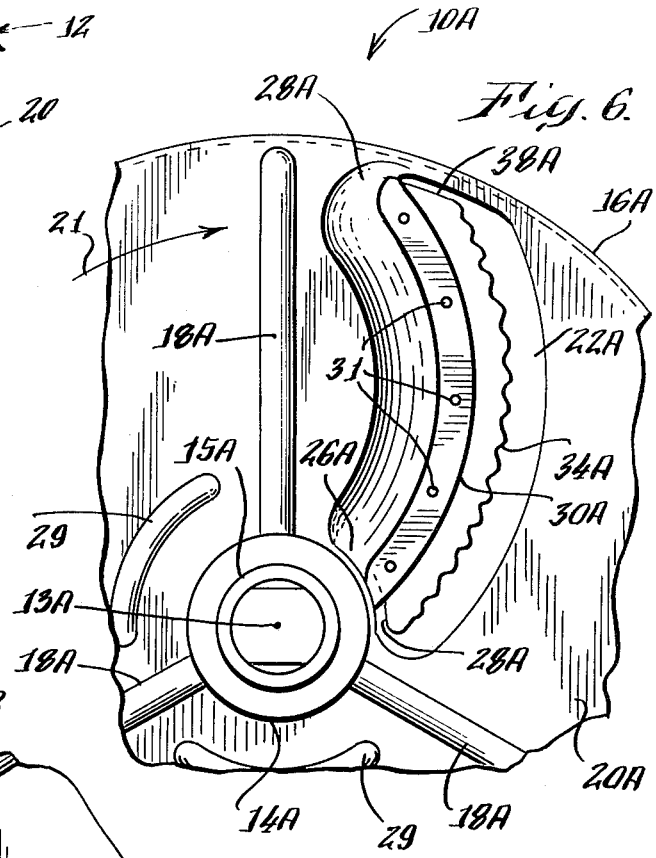
Fig. 6.
Fig. 7.
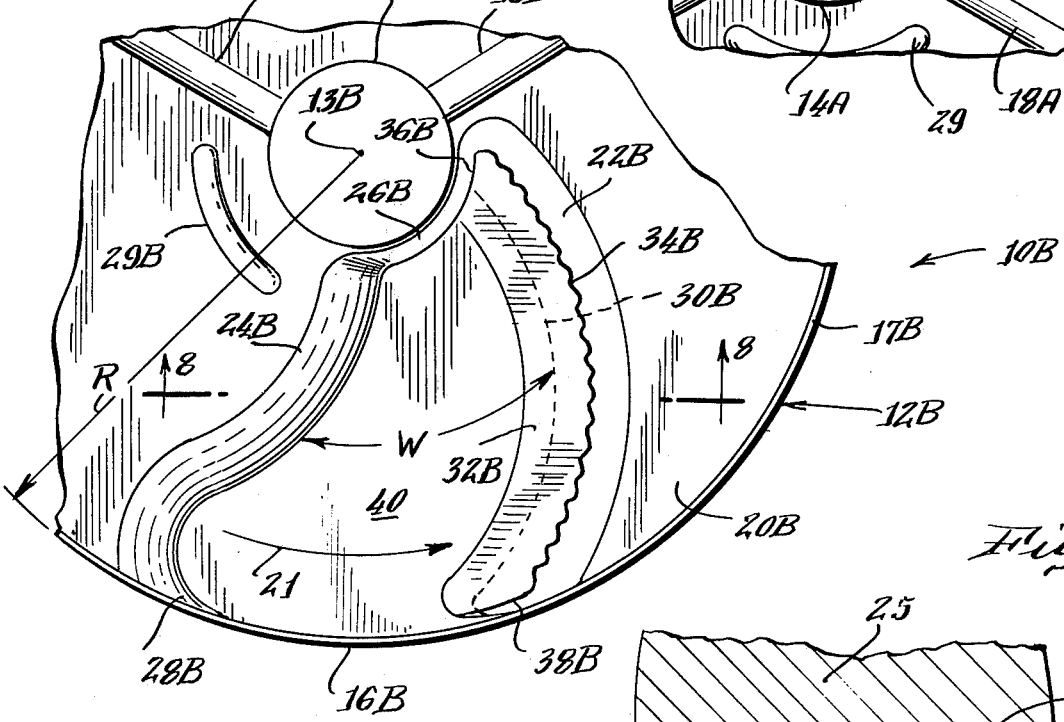
Fig. 8.
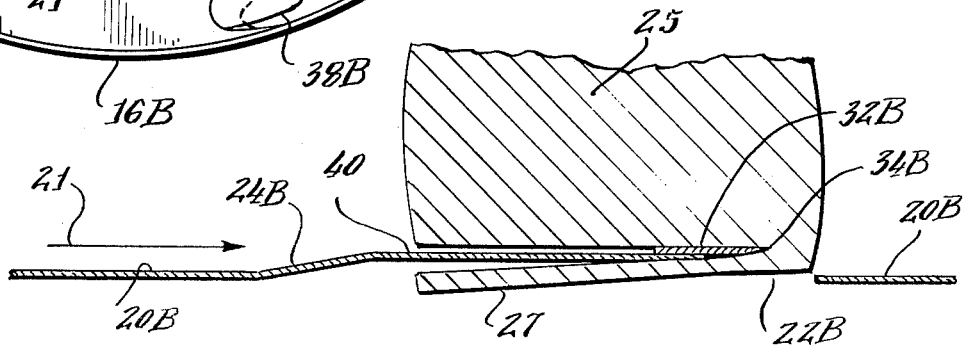

ROTARY SLICING TOOL FOR MAKING NEAT, COMPLETE SLICES IN A FOOD PROCESSOR

FIELD OF THE INVENTION

This invention relates to a rotary food slicing tool of the type used in a food processor, and more particularly to such a rotary food slicing tool having an elevated slicing blade on a rotary disc with a gentle slope located behind and below the slicing blade for performing uniform slicing and cutting operations on food items while advantageously avoiding any smashing, stripping, shredding or other interference with the attractive, delicate slices being formed and passing down through the slot in a disc-like member.

BACKGROUND OF THE INVENTION

Food processors are available which generally include a working bowl with a motor driven shaft projecting into the bowl on which various selected rotary tools can be engaged to be driven by the shaft for performing various food processing operations, such as cutting, slicing, grating, etc. A detachable cover which is secured over the top of the bowl during use includes a hopper or feed tube which has a mouth opening downwardly through the cover into the top of the bowl. The food items to be prepared are placed in the feed tube and pushed down through the feed tube into the bowl by means of a removable, manually operable pusher member which is adapted to slide down in a manner of a plunger into the feed tube, thereby bringing the food items into contact with the rotary tool being employed. Additional information with respect to this type of automatic food processing apparatus may be obtained from U.S. Pat. Nos. 3,892,365 to Pierre Verdon; 3,985,304 to the present inventor; and 4,127,342 to Marcel Coggiola.

Of particular interest to the present invention is the rotary cutting tool which is used for slicing food items such as cucumbers, onions, potatoes, carrots, celery, cabbage, squash, beets, avacado, etc. Such a rotary slicing tool has a horizontal disc-like member formed of sheet metal, preferably stainless steel, which is mounted on an elongated hub extending down in the bowl of the food processor and engaged onto the motor-driven shaft. The disc-like member has a horizontal area which may include a down-turned flange around its perimeter and has an arcuate slot extending from the hub out to the periphery of the disc-like member. An arcuate slicing blade is mounted on the disc-like member behind the slot with its cutting edge projecting forward and elevated above the level of the horizontal area and facing forward above the slot for slicing of food items, with the delicate slices of food passing down through the slot.

In the prior art such rotary slicing tools are characterized by having a sharply sloping shoulder on which an arcuate rim is formed overlying the arcuate slot with the slicing blade being mounted on this rim. As seen in plan view the sharply sloping shoulder intersects with the cutting edge near the periphery of the disc-like member and converges with the cutting edge near the hub. Thus, this sharply sloping shoulder interferes with the uniform slicing of food items near both extremities of the slicing blade, and particularly so in the region near the periphery of the disc-like member, where the relative velocity of this sharply sloping shoulder near the periphery of the fast-turning tool is high with respect to the stationary food item being sliced.

Interference by the shoulder in this peripheral region with the slices being formed causes smashing, shreading or stripping of the slices, thereby rendering them unattractive in appearance and often partially destroying the slices and severing narrow strips of food material from the side edges of an incompleted slice. A uniform and complete slicing operation is not performed by such prior art slicing tools. In effect, the fast-travelling sharply sloping shoulder on a prior art rotary slicing tool tends to clobber the delicate slices being formed. This impacting action of the sharply sloping portion of the disc along its entire length may waste a portion of the food item, may pulverize, smash, strip or shred a portion of the slice or may otherwise interfere with the desired neat slicing function.

Moreover, the impact with the slice being formed of this sharply sloping portion of the disc along its entire length (and particularly so near the periphery of the disc where relative velocities are greatest) often splatters fragments of the food and juices over substantially the entire inner surface of the wall of the working bowl. Such a splattering is unattractive and requires considerable clean up of the bowl.

SUMMARY OF THE PREFERRED EMBODIMENTS OF THE INVENTION

It is an object of the present invention to provide a new and improved rotary food slicing tool which provides a greatly enhanced performance in carrying out its slicing operation in a neat and efficient manner, with complete slices being uniformly produced. That is, each resulting slice is a smoothly completed sectional cut made through the food item in the plane of travel of the slicing blade.

Another object of this invention is to provide a new and improved rotary food slicing tool which provides a neat, uniform and complete slicing function without significantly shredding, smashing, stripping or otherwise damaging the slices made thereby.

Among the advantages of utilizing a rotary food slicing tool embodying this invention area those resulting from the fact that the food items are cleanly sliced into attractive slices, which are complete sectional cuts neatly taken through the food item and almost always fall down flat in the bottom of the working bowl, while leaving the interior surface of the wall of the bowl free from any significant splattering of food particles or juices.

In carrying out this invention in one illustrative embodiment thereof, an improved rotary food slicing tool is provided with a horizontal disc-like member secured to the top of an elongated hub. The disc-like member has a horizontal area which may include a down-turned flange around its perimeter with an arcuate slot therein extending from the hub out to the periphery of the disc-like member. An elevated arcuate rim extending forward toward and above the slot has an arcuate slicing blade mounted thereon with its cutting edge above the level of the horizontal area and facing forward above the slot for slicing food items, with the resulting attractive slices passing unimpeded down through the slot. An integral, gradually sloping shoulder joins the horizontal area of the disc-like member with the elevated rim on which the arcuate slicing blade is mounted. The ends of this slicing blade are contoured to conform with the rotational direction of travel; thus, the outer blade end conforms with the contour of the periphery of the disc-like member, and the inner blade end conforms with the contour of the hub. The cutting edge is spaced well forward of the gradually shaped sloping shoulder near both ends of the slicing blade. The shoulder is also gently sloped, rounded and contoured on its extremities to conform with the relative direction of motion of the disc with respect to the delicate slices of food being formed and passing down through the slot in the rapidly rotating tool. Consequently, food items fed toward the disc-like member are uniformly sliced by the blade with the slices being gently deflected by or entirely missing the gradually sloping contoured shoulder without being smashed or otherwise damaged particularly near the outer extremity of the slicing blade near the periphery of the fast-turning disc-like member. In a further embodiment the slicing blade is mounted on a relatively wide, elevated platform which effectively spaces the cutting edge of the blade farther ahead of the sloping connecting shoulder to the horizontal area of the disc-like member such that this shoulder does not interfere with the slices of food items passing down through the slot of the rotary tool.

BRIEF DESCRIPTION OF THE DRAWINGS

Further objects, features, aspects and advantages of this invention will be more fully understood from a consideration of the following detailed description taken in connection with the accompanying drawings, in which:

FIG. 5 is a partial bottom view of the prior art rotary slicing tool illustrated in FIGS. 1 and 2;

FIG. 6 is a partial bottom view of the rotary food slicing tool shown in FIGS. 3 and 4;

FIG. 7 is a partial top view of another embodiment of the rotary food slicing tool in accordance with the present invention; and FIG. 8 is a somewhat enlarged cross-sectional view taken along line 8—8 of FIG. 7 also illustrating a food item being sliced.

DESCRIPTION OF THE PREFERRED EMBODIMENTS

Figure 1:
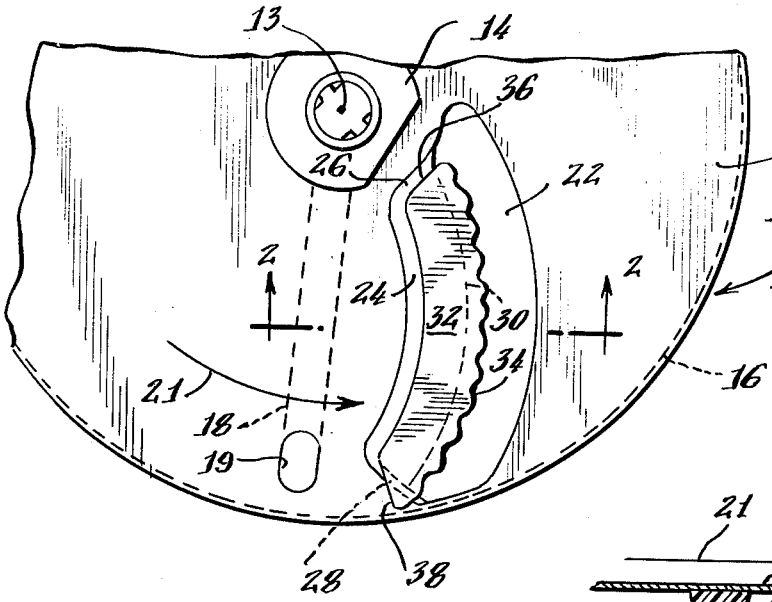
Fig. 1. (PRIOR ART)
FIG. 1 is a partial top view of one type of prior art rotary slicing tool.

In the following description like elements will bear the same reference characters while similar elements which are modified will bear the same reference characters followed by a letter.

Figure 2:
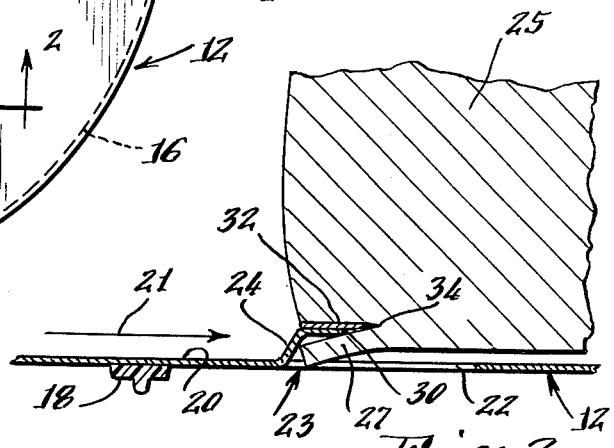
Fig. 2. (PRIOR ART)
FIG. 2 is a somewhat enlarged cross-sectional view taken along line 2—2 of FIG. 1 additionally showing a food item being sliced by the blade of the rotary tool.

Reference is first made to FIGS. 1, 2 and 5 which illustrate a prior art rotary food slicing tool referred to generally with the reference character 10 and which is described in detail herein in order to illustrate clearly by comparison the improved structure and performance of rotary slicing tools embodying the present invention. The prior art rotary food slicing tool 10 includes a disc-like member 12 which is rotated about the axis 13 of a relatively long hollow hub 15 (See FIG. 5) molded from rigid, impact resistant plastic material. This hollow hub 15 has a head 14 for mounting the disc-like member 12 on the hub. The disc-like member 12 is formed of sheet metal, preferably stainless steel, having a down-turned flange 16 extending around its perimeter. A horizontal area 20 of this disc member 12 may be stiffened by a plurality of radial ribs 18 molded integrally with the hub. The hollow hub 15 along with the hub head 14 and the radial ribs 18 extending therefrom are shown as molded of rigid plastic material which is molded through a mounting aperture in the center of the disc-like member 12, with the outer ends of the ribs 18 being molded into small attachment apertures 19 in the disc member.

The prior art rotary food slicing tool 10 is used for slicing food items such as those listed above as well as many others. The direction of rotation and motion of the tool relative to the food item being sliced is shown by arrows 21 in the various figures. The disc-like member 12 includes an arcuate slot 22 formed in the horizontal area 20 and extending from a region near the hub head 14 out to the peripheral flange 16. The trailing edge of the slot 22 is pressed upwardly to form an arcuate rim 30 behind the open slot 22. The rim 30 is joined with the horizontal area 20 by a sharply downwardly sloping shoulder 24 which juts sharply inward toward the slot 22 at shoulder end 26 adjacent to the hub head 14 and on the other extremity thereof at shoulder end 28 adjacent to the inner surface of the flange 16.

A curved hardened steel slicing blade 32 is spot-welded at 31 (FIG. 5) onto the rim 30 having an arcuate sharpened cutting edge 34 which projects forwardly partially over and above the open slot 22. The cutting edge 34 may be slightly scalloped or serrated as seen in FIG. 1. The rim 30 is located only approximately $\frac{1}{8}$th of an inch behind the cutting edge 34.

As is illustrated in FIG. 2 a food item 25, for example such as a peeled potato, which is fed toward the upper surface of the disc-like member 12 is sliced by the cutting edge 34 of the slicing blade 32 and a slice 27 therefrom begins to be formed and is deflected downwardly by the blade 22 and by the rim 30. The edge of this newly formed slice 27 is struck forcefully by the steeply sloping shoulder 24 as shown by the impact at 23. Since the slicing tool 10 is rotating at a fairly high rate, for example such as 1,000 to 2,000 rpm, the impact with the abruptly downwardly sloping shoulder 24 may smash or otherwise disfigure the edge of the slice 27. The steeply rising shoulder 24 as illustrated in a prior art tool is inclined at an angle of 45° or greater to the horizontal area 20 of the disc-like member 12.

This problem of having the sliced food items hit by the steeply sloped shoulder 24 is compounded near the extremities of the cutting blade 32. From FIGS. 1 and 5 it will be seen that the inner and outer ends 26 and 28 of the shoulder jut sharply forward abruptly toward the respective ends of the slot 22. Also, the inner and outer extremities 36 and 38 of the cutting blade 32 tend to merge with the inner and outer edges of the sheet metal of the disc 12 along the shoulder ends 26 and 28, respectively. This shoulder edge structure and its relationships with the blade ends as shown causes severe problems in the slicing operation near the respective extremities 36, 38 of the cutting blade 22 and most particularly at the outer blade extremity 38 near the periphery of the disc-like member 12 where the relative motion 21 between the fast-travelling periphery of the disc-like member 12 and the stationary food item 25 is great. Newly formed slices of food items which are passing down through the slot are smashed, splattered or strips are severed therefrom due to the contact between each food slice 27 and the steeply sloped shoulder edge 28 as well as to a lesser degree with the steeply sloped inner shoulder edge 26. In other words, an incomplete slice is formed including a central sliced portion and strip portions severed from the inner or outer or both edges of the slice.

Moreover, the smashing impact 23 (FIG. 5) tends to splatter food fragments or particles and juices and hurls them toward the wall of the working bowl in which the rotary tool 10 is being used. Thus, the bowl becomes unattractively splattered, food is wasted, and the bowl requires frequent substantial cleaning efforts to prevent slices of each subsequent food item from being specked with the remains of the previous item. For example, if carrots for a salad are sliced before cucumbers, the bowl should be wiped free of the orange carrot fragments if the user desires to avoid orange speckles on the cucumber slices, and such frequent cleaning is an awkward, fustrating inconvenience to the user.

Figure 3:
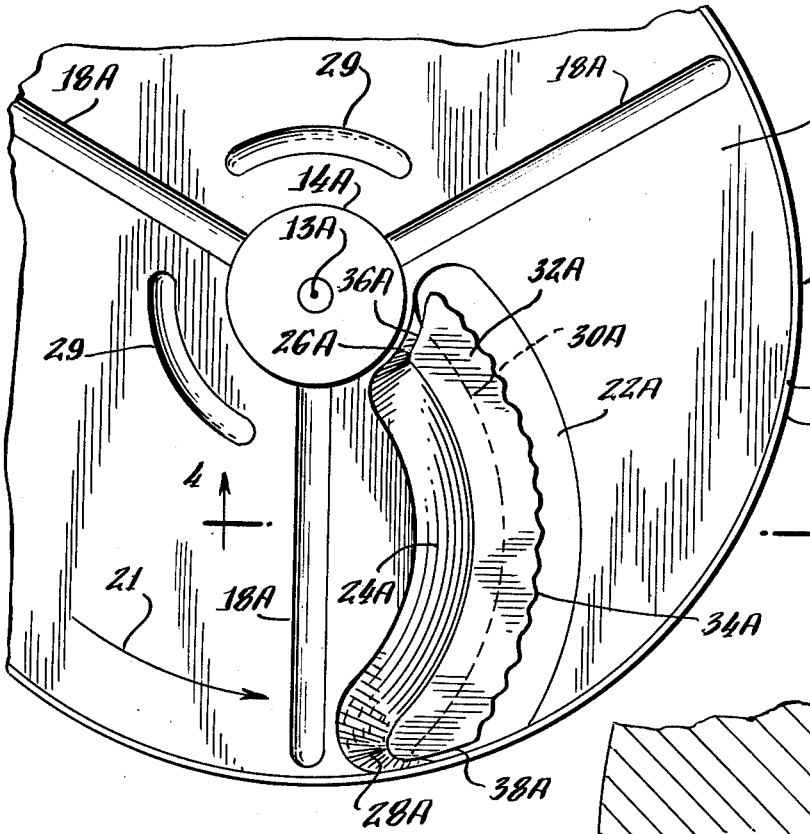
FIG. 3 is a partial top view of a rotary slicing tool embodying the present invention.
Figure 4:
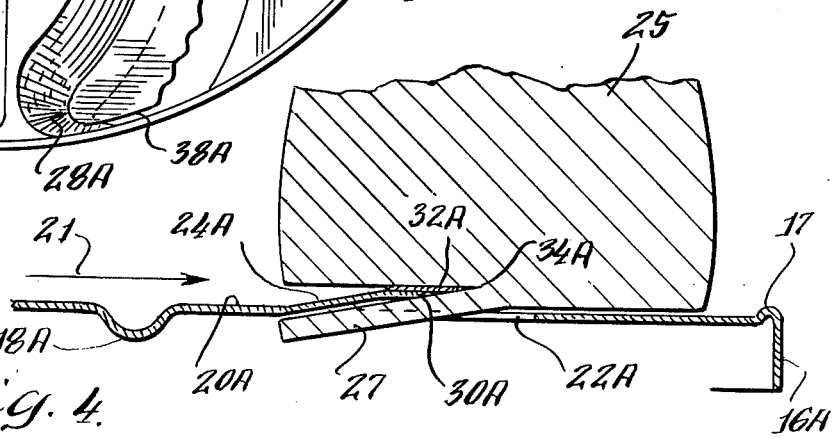
FIG. 4 is a somewhat enlarged cross-sectional view taken along line 4—4 of FIG. 3 including a food item being sliced.

The aforesaid problems with the prior art are advantageously avoided by a rotary slicing tool 10A embodying this invention, as shown in FIGS. 3, 4 and 6. This novel slicing tool 10A is shown larger than the tool 10, because both FIGS. 1 and 3 are drawn full scale, and the new tool 10A is actually considerably larger, and it has a greater slicing capacity, for example being approximately 6¼ inches in diameter as compared with approximately 5½ inches for the prior art tool 10. The disc-like member 12A includes an arcuate slot 22A formed in the horizontal metal area 20A and extending from the hub head 14A to the peripheral flange 16A. The disc-like element 12A has a bead hip 17 for the flange 16A to add stiffness to the disc-like element 12A. The horizontal area 20A of the disc-like member 12A is stiffened by a plurality of embossed radial ribs 18A and embossed arcuate ribs 29 formed by indenting rounded grooves having a generally semi-circular cross-sectional configuration and being located in the horizontal area 20A as shown in FIG. 3. The trailing edge of the slot 22A is pressed upward to form a gently descending shoulder 24A which is terminated in a rim 30A forming the trailing edge of the slot 22A. This rim 30A is preferably positioned at least ¼th of an inch behind the cutting edge 34 of the slicing blade 32A. This curved cutting blade 32A with its forwardly projecting cutting edge 34 is secured to the rim 30A, for example by spot welding at 31 (FIG. 6) such that the arcuate cutting edge 34 thereon projects forward partially over and above the open slot 22A.

The gently sloping shoulder 24A terminates in a rounded contoured inner shoulder end 26A, the contour of the inner portion of which conforms generally with the shape of a sector of the hub 14A. In other words, the inner portion of the shoulder end 26A extends generally in a direction concentric about the axis 13A so that it is aligned with the direction of motion of that region of the disc-like member 12A with respect to the food being sliced. Consequently, the shoulder end 26A cannot impact with any significant adverse effect against the edge of a newly formed slice 27. At the outer extremity the shoulder end 28A is contoured generally with the shape of the periphery of the disc-like member 12A. Again, the outer portion of the outer shoulder end 28A extends generally concentric about the axis 13A so that it aligns with the relative motion of that region of the disc-like member 12A with respect to the food being sliced. Accordingly, this outer shoulder end 28A does not impact with any significant undesired effect against a newly formed slice 27. The configuration of the gently sloping shoulder 24A and its shoulder ends 26A and 28A should be compared with the steeply sloped shoulder 24 along with its jutting shoulder edges 26 and 28 as shown in FIG. 1.

The slicing or cutting blade 32A is also contoured along its inner end 36A to conform with the general curvature of the shoulder edge 26A while the outer blade end 38A also conforms with the general contour of the curvature of the outer shoulder edge 28A. It should also be noted that the cutting edge 34A is spaced well forward at its outer extremity 38A and at its inner extremity 36A with respect to the arcuate outer and inner shoulder edges 38A and 36A, respectively, and thus does not tend to merge with these shoulder edge as in the prior art slicing tool 10. A comparison between FIG. 1 and FIG. 3, and FIG. 5 and FIG. 6 clearly illustrates the many differences in spacing, contouring, sloping and interrelationships which have been described in detail.

Referring now to FIG. 4 where a slicing operation is illustrated, a food item 25 is being fed toward the top horizontal surface 20A of the disc-like member 12A and is brought in contact with the cutting edge 34A. A newly formed slice 27 commences passing down through the slot 22A and is deflected by the blade 32A and rim 30A down through the slot 22A. The gentle slope 24A which is preferably on the order of less than 20° does not interfere with the slice 27 being removed from the foot item 25. It should be noted in FIG. 4 that the width of the cutting blade 32A is less than the horizontal width of the slope 24A. In the prior art configuration, the steep slope 24 has a width dimension in the horizontal direction which is less than one-half of the width of the cutting blade 32 (See FIG. 2).

With respect to the inner and outer blade extremities, contouring of the blade ends 36A and 38A to conform with the contouring of the shoulder edges 26A and 28A, respectively and generally to extend in a circumferential direction with respect to the axis 13A, and the spacing of the cutting edge 34A well forward of the shoulder edges 26A and 28A direct the slice 27 which is being cut down into the slot 22A and down smoothly along the gently sloping shoulder 24A such that clean, uniform and complete sectional slices are repetitively made. Each slice is a cleanly cut and complete section passing completely through the food item in the plane of travel of the slicing blade 32A. Where there is a natural pattern or texture in the food item 25, for example such as in the interior of a large cucumber, this pattern is attractively preserved in each neatly completed slice.

FIGS. 7 and 8 illustrate another embodiment of the present invention in which a contoured, wide, elevated platform 40 extends for a substantial distance in a direction concentric about the axis 13B thereby projecting over and forward forming the rear of a slot 22B. A cutting blade 32B having contoured extremities 36B and 38B thereon is mounted on the forward lip 30B of this elevated platform such that the blade 32B has a cutting edge 34B projecting forwardly and partially over the above the open slot 22B. The platform 40 is supported along its trailing portion by a gently sloping contoured shoulder 24B having contoured extremities 26B and 28B thereon which conform generally to the shape of the blade edge 36B as well as to a sector of the hub 14B while the shoulder 28B generally conforms with the shape of the periphery of the disc-like member 12B. The elevated platform 40 has a width near the flange 16B extending concentrically about the axis 13B more than twice the width of the blade 32B and has a width W as measured along an arc concentric about the axis 13B and passing through the platform mid-way between the hub and periphery which is more than one-third of the radius R of the disc-like member.

As will be seen in FIG. 8, a food item 25 coming into contact with the cutting edge 34 has a slice 27 neatly and cleanly removed which clears the platform 40 and its gently sloping contoured shoulder 24B such that repeated uniform slices are provided. Again, in this embodiment the cutting edge 34B is spaced well forward of the shoulder edges 36B and 38B to direct the slice 27 which is being cut down into the slot 22B and down toward the rear for generally clearing the gently sloping shoulder 24B for cleanly forming a neat complete slice without any of the undesirable deterioration produced by the bashing or edge severing impacts of the prior art slicing tools.

Since other modifications and changes varied to fit particular operating requirements and environments will be apparent to those skilled in the art, the invention is not considered limited to the examples chosen for purposes of illustration, and includes all changes in modifications which do not constitute a departure from the true spirit and scope of this invention as defined in the following claims.

What is claimed is:

1. A rotary food slicing tool for rotating at a high rate of the order of 1,000 to 2,000 rpm having a rotatable hub with a horizontal disc-like cutting member secured to said hub for rotation therewith in a predetermined direction of rotation about an axis, said disc-like member having a horizontal area with a flange around the perimeter thereof, said horizontal area having a slot therein extending from near said hub out to the periphery of said disc-like member, said disc-like member having an elevated rim behind said slot, and a slicing blade mounted on said elevated rim behind said slot with a cutting edge projecting forward at an elevation above said horizontal area and facing forward toward said slot for slicing food items fed toward said disc-like member, the improvement for producing complete and neatly cut slices from such a food item comprising:

(a) a wide elevated platform extending rearwardly from said elevated rim at an elevation above the level of said disc-like member, (b) said wide elevated platform having a width near said flange of said disc-like member extending concentrically about the axis more than twice the width of the blade, (c) said slicing blade having its ends contoured to conform with the general contour of the periphery of said disc-like member on one extremity thereof and with the shape of the hub on the other extremity thereof, (d) said blade being mounted on the forward edge of said elevated platform with its cutting edge being spaced forward of said edge on both extremities of said blade, and (e) said wide elevated platform being joined to said disc-like member by an integral gradually sloping shoulder being rounded and contoured to conform with the general contour of the periphery of said disc-like member and with said hub, whereby food items fed toward said disc-like member are cleanly, neatly and uniformly sliced by said blade with the sliced food items gently sliding beneath said elevated platform and said gradually sloping contoured shoulder for forming complete, neat slices without any significant smashing, stripping or splattering of food materials.

2. A rotary food slicing tool for rotating at a high rate of the order of 1,000 to 2,000 rpm having a rotatable hub with a horizontal disc-like cutting member secured to said hub for rotation therewith in a predetermined direction of rotation, said disc-like member having a horizontal area, said horizontal area having an arcuate slot therein extending from near said hub out to the periphery of said disc-like member, said disc-like member having an elevated arcuate rim extending along the trailing edge of said slot, and a slicing blade mounted on said elevated rim behind said slot with a cutting edge projecting forward at an elevation above said horizontal area and facing forward toward said slot for slicing food items fed toward said disc-like member, the improvement comprising:

(a) a wide elevated platform extending rearwardly from said elevated rim at an elevation above the level of said disc-like member, (b) said wide platform having a width W as measured rearwardly from the forward edge of said rim along an arc concentric about the axis of rotation of said slicing tool, said measurement arc being located mid-way between the hub and the periphery of said disc-like member, (c) said width W being more than one-third of the radius of said disc-like member, (d) said wide, elevated platform being joined to said disc-like member by an integral gradually sloping shoulder, and (e) said slicing blade being mounted on the forward edge of said elevated platform and projecting forwardly beyond said edge.

3. The rotary food slicing tool as claimed in claim 2, in which:

said shoulder is reduced and contoured to conform with the general contour of the periphery of said disc-like member, whereby food items fed toward said disc-like member are uniformly sliced by said blade without interference by said platform or shoulder.

4. The rotary food slicing tool set forth in claim 2 or 3 in which said cutting edge is spaced forward from the forward edge of said platform along the entire length of the forward edge of said platform.

5. A rotary flood slicing tool for rotating at a high rate of the order of 1,000 to 2,000 rpm having a rotatable hub with a horizontal disc-like cutting member secured to said hub for rotation therewith in a predetermined direction of rotation, said disc-like member having a horizontal area with a flange around the perimeter thereof, said horizontal area having an arcuate slot therein extending from near said hub out to the periphery of said disc-like member, said disc-like member having an elevated, arcuate rim behind said arcuate slot, and an arcuate slicing blade mounted on said elevated rim behind said slot with a cutting edge projecting forward at an elevation above said horizontal area and facing forward toward said slot for slicing food items fed toward said disc-like member, the improvement for producing complete and neatly cut slices from such a food item comprising:

(a) an integral, gradually sloping shoulder joining said horizontal area of said disc-like member with said elevated rim, (b) said shoulder sloping downwardly at a gradual angle of less than 20° with respect to said horizontal area, (c) said arcuate slicing blade having its ends contoured to conform with the general contour of the periphery of said disc-like member on one extremity thereof and with the shape of the hub on the other extremity thereof, said cutting edge being spaced forward of said graudally sloping shoulder on both extremities of said slicing blade, and (d) said shoulder being rounded and contoured to conform with the general contour of the periphery of said disc-like member and with said hub, (e) a wide horizontal platform extending rearwardly from said elevated rim at the same elevated level as said rim, (f) said wide horizontal platform having a width W as measured rearwardly from the forward edge of said rim along an arc concentric about the axis of rotation of said slicing tool (g) said measurement arc being located mid-way between the hub and the periphery of said disc-like member, (h) said width W is more than one-third of the radius R of said disc-like member, and (i) said gradually sloping shoulder joins said horizontal area of said disc-like member with the rearward portion of said wide horizontal elevated platform, whereby food items fed toward said disc-like member are cleanly, neatly and uniformly sliced by said blade with the sliced food items gently sliding beneath said elevated platform and gradually sloping contoured shoulder for forming complete, neat slices without any significant smashing, stripping or splattering of food materials.

* * * * *